US007213685B2

(12) United States Patent
Hikita

(10) Patent No.: US 7,213,685 B2
(45) Date of Patent: May 8, 2007

(54) CONTROL DEVICE AND CONTROL METHOD FOR ELEVATOR

(75) Inventor: Shiro Hikita, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 643 days.

(21) Appl. No.: 10/808,466

(22) Filed: Mar. 25, 2004

(65) Prior Publication Data

US 2005/0126863 A1 Jun. 16, 2005

(30) Foreign Application Priority Data

Dec. 11, 2003 (JP) ..... 2003-413406

(51) Int. Cl.
*B66B 9/00* (2006.01)

(52) U.S. Cl. ..... 187/249; 187/382; 187/385

(58) Field of Classification Search ..... 187/380–389, 187/247, 249, 414, 391, 393, 394
See application file for complete search history.

(56) References Cited

U.S. PATENT DOCUMENTS

| | | | | |
|---|---|---|---|---|
| 1,458,881 | A * | 6/1923 | Gromer | 104/28 |
| 5,865,274 | A * | 2/1999 | Kiji et al. | 187/380 |
| 5,877,462 | A * | 3/1999 | Chenais | 187/249 |
| 6,273,217 | B1 * | 8/2001 | Hikita | 187/388 |
| 6,364,065 | B1 * | 4/2002 | Hikita | 187/382 |
| 6,955,245 | B2 * | 10/2005 | Dunser et al. | 187/382 |
| 2006/0016640 | A1 * | 1/2006 | Duenser et al. | 187/249 |

FOREIGN PATENT DOCUMENTS

| | | |
|---|---|---|
| JP | 6-305648 | 11/1994 |
| JP | 8-225268 | 9/1996 |
| JP | 2000-63058 | 2/2000 |

OTHER PUBLICATIONS

A. Fujino et al., "Basic Study on Mass Transportation Systems in Buildings by Means of Multiple-cage Elevators", *IEEE*, (1997), pp. 815-822, 117-D(7), Japan.

* cited by examiner

*Primary Examiner*—Jonathan Salata
(74) *Attorney, Agent, or Firm*—Leydig, Voit & Mayer, Ltd.

(57) ABSTRACT

An elevator control device which realizes, in a multi-car system, operation control superior in transportation efficiency. A first shunting device outputs a first shunting command for moving a car which has responded to a call request to a shunting floor. A blocked state detection device detects a blocked state in which a succeeding car cannot run due to a preceding car being in a standby state at a shunting floor, and outputs blocked-state-generation information. A second shunting device outputs a second shunting command for moving the preceding car in the standby state to a new shunting floor based on the blocked-state-generation information. Further a collective operation control device collectively controls the operation of each car based on information for each car, the first shunting command from the first shunting device, and the second shunting command from the second shunting device.

2 Claims, 5 Drawing Sheets

CONTROL DEVICE AND CONTROL METHOD FOR ELEVATOR

BACKGROUND OF THE INVENTION

1. Field of the Invention

The present invention relates to a control device and a control method for an elevator of the type in which the operation of a plurality of cars running in the same shaft is controlled.

2. Description of the Related Art

An ordinary elevator system adopts a form in which one car serves in one shaft. In contrast to such an ordinary elevator system, there exists a one-shaft multi-car system in which a plurality of cars serve in one shaft, and various proposals have been made regarding such a multi-car system.

In the most typical form proposed, an ascent shaft, a descent shaft, and connection shafts connecting the terminal floors thereof form a shaft loop in which cars run (a circulation type running shaft), and a plurality of elevator cars run in this loop in a circulating manner. In such a multi-car system, a plurality of cars run in the same shaft.

In performing operation control in the case in which a plurality of cars run in the same shaft, attention must be paid to the following points. First, it is necessary to prevent the cars from colliding with each other. Further, when there is generated a blocked state, in which a succeeding car cannot run due to a preceding car being in a standby state, it is necessary to get rid of such a blocked state, thereby achieving an improvement in transportation efficiency.

Regarding the former point, that is, the prevention of collision, a control method is available according to which there is provided a block distance between a preceding car and a succeeding car, keeping the succeeding car off the preceding one by a distance not smaller than the block distance (see, for example, JP 3029168 (hereinafter referred to as Patent Document 1)). Regarding the latter point, that is, the achievement of an improvement in transportation efficiency, a control method is available according to which, when a car is about to pass a floor generating a landing call, an unbalance in the allocation of cars is evaluated to thereby make a judgment as to whether the car is to be stopped at that floor in response to the landing call or not (see, for example, Treatise D of the Japanese Electro-technical Committee, vol. 117, No. 7, pp. 815 to 822 (1997)(hereinafter referred to as Non-Patent Document 1)).

However, the above-mentioned prior-art techniques have the following problems. Patent Document 1 only describes a collision preventing method and mentions nothing about avoidance of a blocked state or achieving of an improvement in transportation efficiency. In Non-Patent Document 1, it is assumed that each car is run in the normal manner. This assumption, however, is considerably unrealistic in an actual system. For example, it would be necessary to run all the cars even during off-peak times such as at nighttime, resulting in considerable waste from the viewpoint of power consumption.

In a normal one-shaft-one-car system, the car responds to every call request unless a special operation is being conducted, and is left in a standby state with the door closed after the passengers have got off. However, if applied to a one-shaft-multi-car system, this concept would, as easily expected, lead to deterioration in transportation efficiency due to a blocked state. Thus, there are problems of how to realize an elevator operation in which cost efficiency is taken into account and of how to achieve an improvement in elevator transportation efficiency.

SUMMARY OF THE INVENTION

The present invention has been made with a view toward solving the above problems. It is an object of the present invention to provide an elevator control device that is capable of realizing an operation control superior in terms of transportation efficiency.

In accordance with the present invention, there is provided an elevator control device including a plurality of cars running in a circulation type running shaft formed by interconnecting an ascent shaft and a descent shaft to each other at upper and lower terminal portions thereof, a plurality of individual car control devices for effecting operation control independently on the plurality of cars, and a group supervisory control device for collectively controlling the plurality of individual car control devices, wherein the group supervisory control device is equipped with a communication means for performing transmission and reception of information to and from the plurality of individual car control devices, a first shunting means for outputting a first shunting command for moving a car which has responded to a call request to a predetermined shunting floor based on information on each car received from the plurality of individual car control devices through the communication means, a blocked state detection means for detecting, on the basis of the information on each car received from the plurality of individual car control devices through the communication means, a blocked state in which a succeeding car is being blocked by a preceding car that is in a standby state at the predetermined shunting floor, and a second shunting means for outputting a second shunting command for moving the preceding car, which is in the standby state at the predetermined shunting floor, to a new shunting floor when it is detected by the blocked state detection means that the succeeding car is in the blocked state.

In accordance with the present invention, a preceding car is appropriately moved based on positional information on each car, whereby it is possible to realize an elevator control device that is capable of realizing an operation control in which a blocked state is avoided and which is superior in terms of transportation efficiency.

BRIEF DESCRIPTION OF THE DRAWINGS

Preferred embodiments of the present invention will be described in detail based on the following figures, wherein.

DESCRIPTION OF THE PREFERRED EMBODIMENTS

First Embodiment

Figure 1:
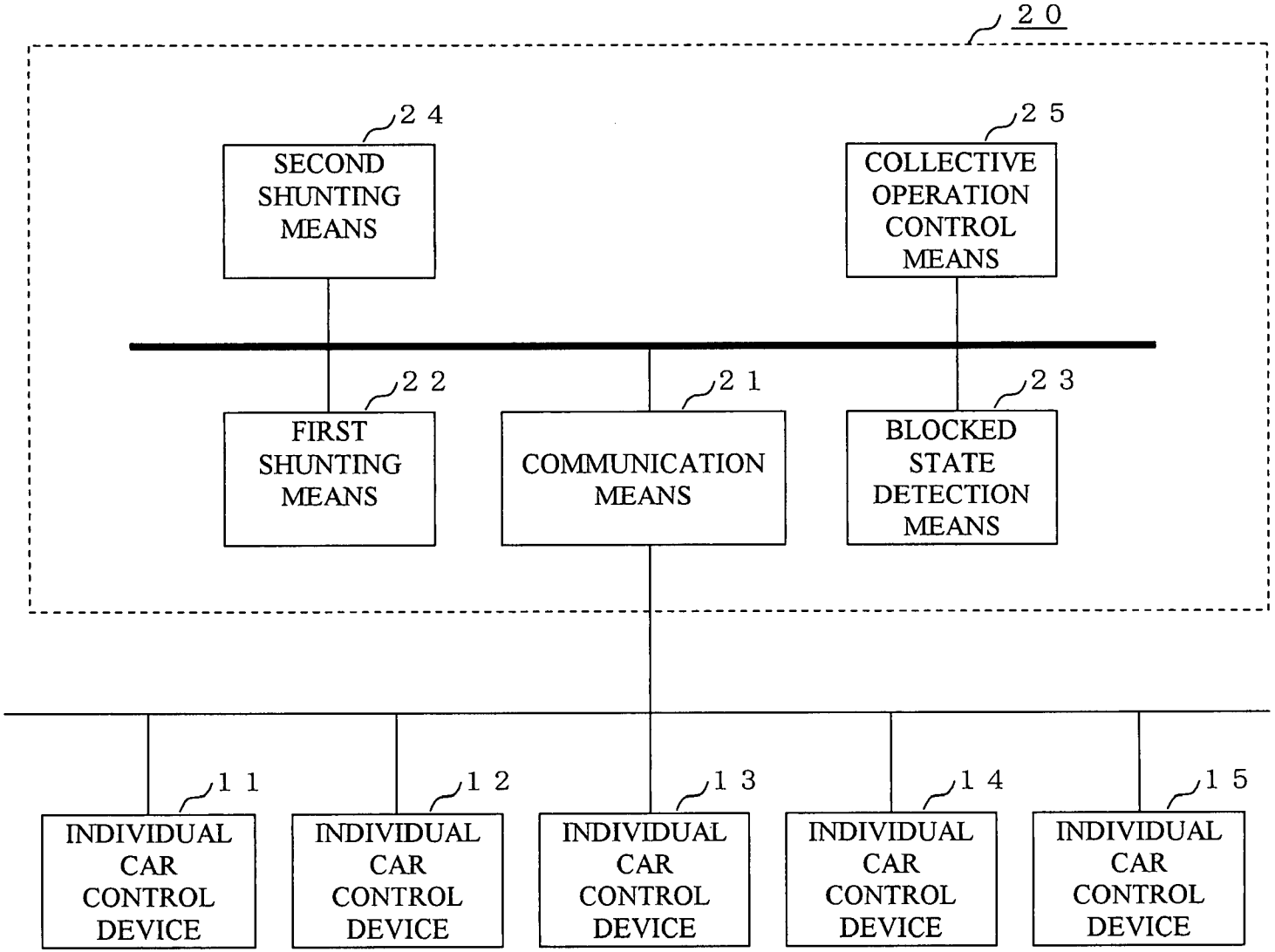
FIG. 1 is a block diagram showing a functional construction of an elevator control device according to a first embodiment of the present invention.

A first embodiment of the present invention will now be described with reference to the drawings. Regarding the first embodiment of the present invention, a case will be described in which supervisory control is efficiently performed on the operation of five cars in a multi-car system. FIG. 1 is a block diagram showing the functional construction of an elevator control device according to the first embodiment of the present invention.

Individual car control devices 11 through 15, which individually perform operation control on the five cars (not shown), are connected to a group supervisory control device 20. To avoid collision between the cars and to achieve an improvement in transportation efficiency, the group supervisory control device 20 collectively performs operation control on the five cars. Here, the group supervisory control device 20 is equipped with a communication means 21, a first shunting means 22, a blocked state detection means 23, a second shunting means 24, and a collective operation control means 25.

The functions with which the group supervisory control device 20 is endowed will now be described in detail. The communication means 21 has an information communicating function for receiving information on each car from the individual car control devices 11 through 15 or for transmitting an operation control command for each car to the individual car control devices 11 through 15. Here, the information on each car from the individual car control devices 11 through 15 includes, for example, information on car operation stop state, current car position, and a call request of a get-off request floor or of a get-on request floor. The operation control command for each car transmitted to the individual car control devices 11 through 15 includes, for example, a car movement command and a car stopping command.

The first shunting means 22 has the function of outputting a first shunting command for moving a car which has responded to a call request to a predetermined shunting floor based on information on each car received from the individual car control devices 11 through 15 through the communication means 21. Here, the predetermined shunting floor refers to a floor to which a preceding car is moved beforehand so as not to hinder the running of a succeeding car; it can also serve as a floor of which frequent get-on request is to be expected. Further, the number of such predetermined shunting floors set in the loop is not restricted to one; it is also possible to set a plurality of such shunting floors. The first shunting means 22 outputs a first shunting command for previously moving a car to such a predetermined shunting floor.

The blocked state detection means 23 has the function of making a judgment as to generation of a blocked state, which is a state in which a succeeding car cannot run due to a preceding car being in a standby state at a predetermined shunting floor based on information on each car received from the individual car control devices 11 through 15 through the communication means 21, and the function of outputting blocked-state-generation information. The blocked state detection means 23 makes a judgment as to generation of a blocked state from the positional relationship between a preceding car and a succeeding car, and outputs blocked-state-generation information for avoiding a blocked state.

The second shunting means 24 has the function of outputting a second shunting command for moving a preceding car that is in the standby state at the predetermined shunting floor to a new shunting floor based on the blocked-state-generation information from the blocked state detection means 23. Here, the new shunting floor refers to a new floor to which the preceding car causing the blocked state is to be moved from the current, predetermined shunting floor. The second shunting means 24 outputs a second shunting command for moving the car to a new shunting floor in order to avoid such a blocked state.

Further, the collective operation control means 25 has the function of collectively controlling the operation of each car based on information on each car received from the individual car control devices 11 through 15 through the communication means 21, the first shunting command from the first shunting means 22, and the second shunting command from the second shunting means 24, outputting an operation control command to the individual car control devices 11 through 15 through the communication means 21. The collective operation control means 25 prevents collision between the cars and avoids a blocked state, performing efficient operation control on the five cars.

Figure 2:
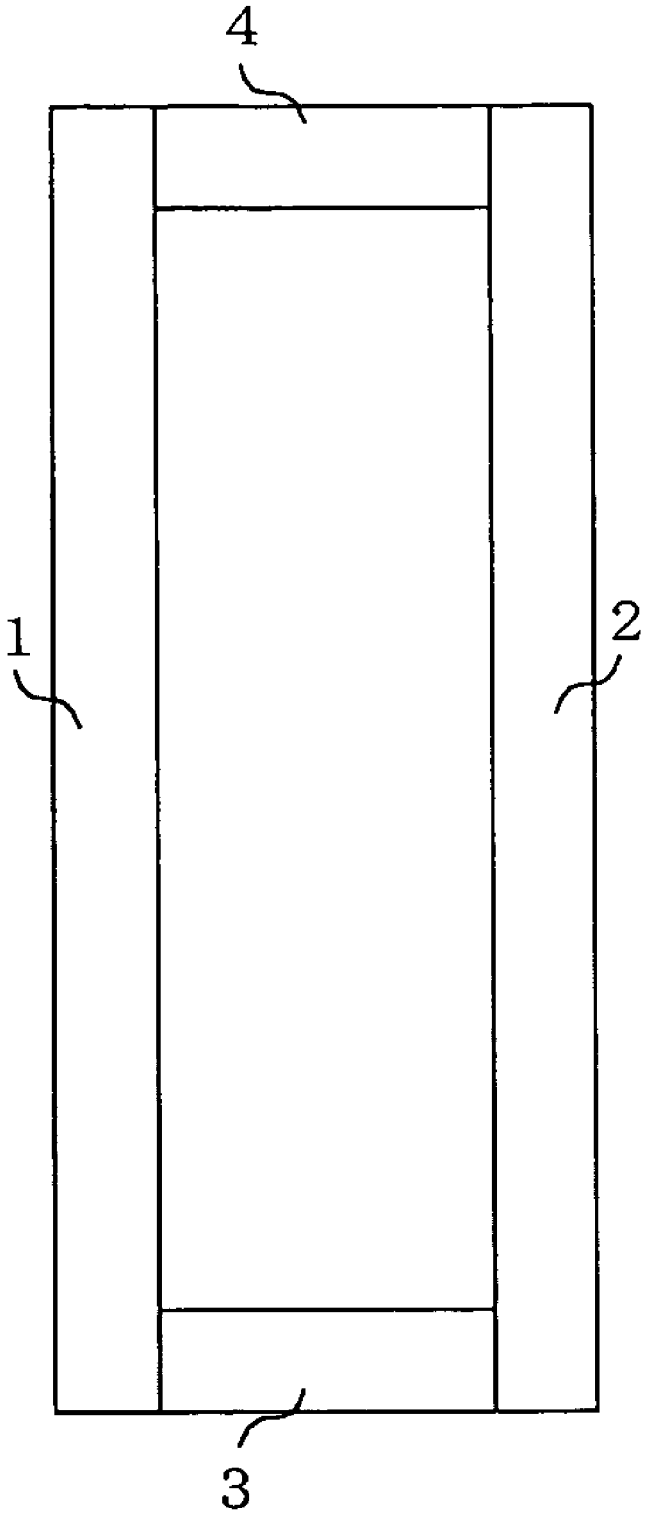
FIG. 2 is a schematic diagram showing a shaft in which cars run in the elevator control device of the first embodiment of the present invention.

FIG. 2 is a schematic diagram showing the shaft in which the cars run in the elevator control device of the first embodiment of the present invention. The shaft in which the cars run is composed of an ascent shaft 1, a descent shaft 2, a lower connection shaft 3, and an upper connection shaft 4, with the four shafts forming a single loop. It is assumed that the cars run through these shafts in the following order: the ascent shaft 1, the upper connection shaft 4, the descent shaft 2, and the lower connection shaft 3 before returning to the ascent shaft 1, thus circulating in the loop in one direction. It is also possible to adopt a construction in which the cars circulate in the reverse direction.

Further, it is to be assumed that the getting on/off of the passengers is effected at one landing hall of the ascent shaft 1 or the descent shaft 2. Further, it is to be assumed that, at the lowermost floor, the passengers get off at the lowermost floor of the descent shaft, and that they get on at the lowermost floor of the ascent shaft. On the other hand, it is to be assumed that, at the uppermost floor, the passengers get off at the uppermost floor of the ascent shaft and that they get on at the uppermost floor of the descent shaft.

Figure 3C:
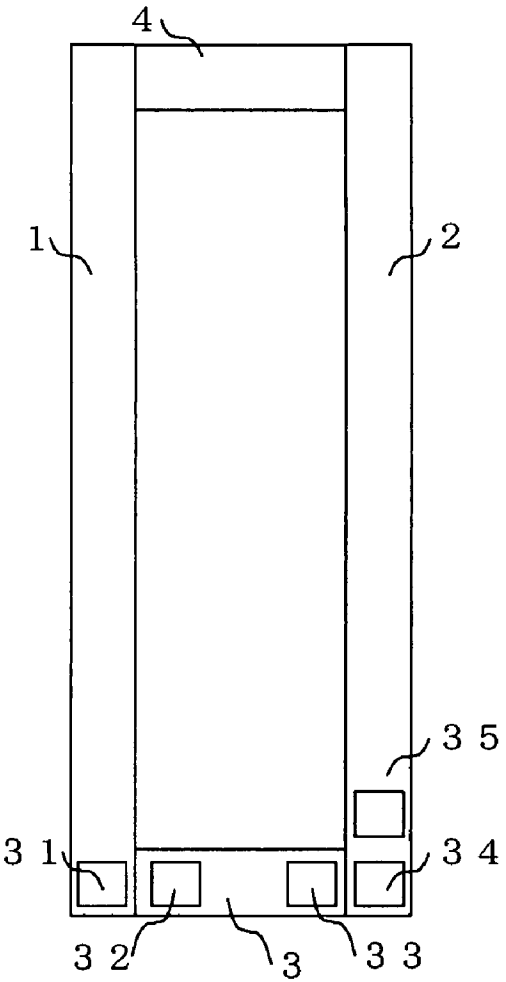
FIGS. 3A through 3C are diagrams showing states of five cars in the first embodiment of the present invention.
Figure 3B:
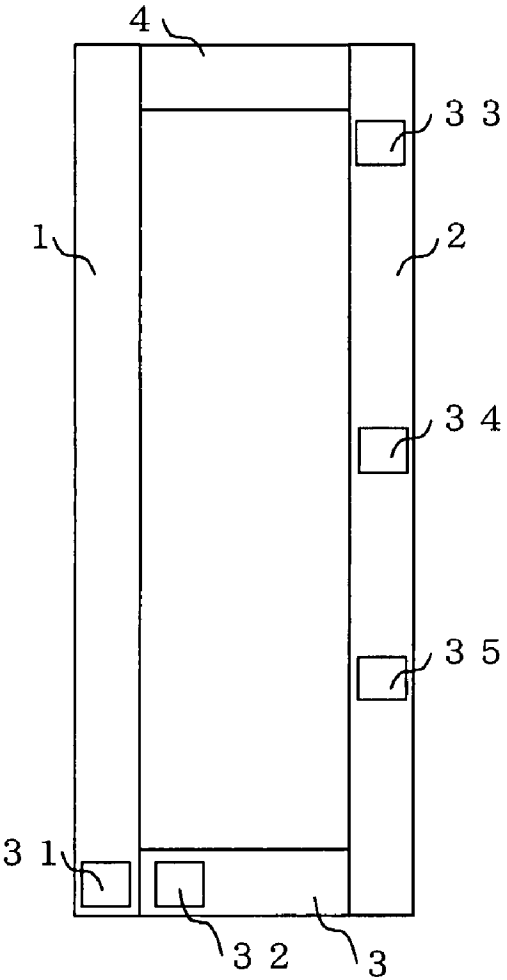
Figure 3A:
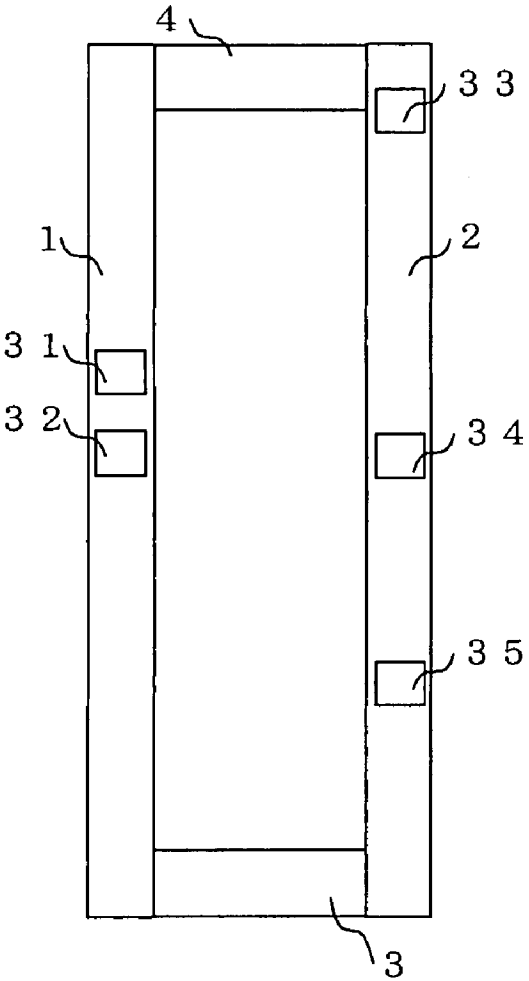

Next, the positional relationship between the five cars in the first embodiment of the present invention will be described with reference to FIGS. 3A through 3C. FIGS. 3A through 3C show the states of the five cars in the first embodiment of the present invention. Three positional relationships between the five cars 31 through 35 in each shaft shown in FIG. 2 are shown in FIGS. 3A through 3C.

FIG. 3A shows a state in which, at a midway floor of the ascent shaft 1, a succeeding car 32 cannot move on due to the presence of a preceding car 31. Here, it is assumed that the passengers have got on/off the preceding car 31 at the midway floor of the ascent shaft 1, that is, a call request has been responded to. Thereafter, the door of the preceding car 31 is closed, and the car is brought into a standby state. Assuming that that preceding car 31 remains at this position, the succeeding car 32 cannot move on to the target floor due to the presence of the preceding car 31 in the ascent shaft 1, that is, a blocked state has been generated.

FIG. 3B shows a blocked state in which the succeeding car 32 is trying to move on to a predetermined shunting floor of the ascent shaft 1, with the preceding car 31 being on standby at the predetermined shunting floor of the ascent shaft 1. Here, the lowermost floor of the ascent shaft 1, which is assumed to be the floor of which get-on request is to be expected most frequently, constitutes the predetermined shunting floor. FIG. 3C shows blocked states successively generated by succeeding cars 33, 34, and 35 trying to move on to the predetermined shunting floor, with the preceding car 31 remaining at the predetermined shunting floor thus maintaining the blocked state of FIG. 3B.

Figure 4:
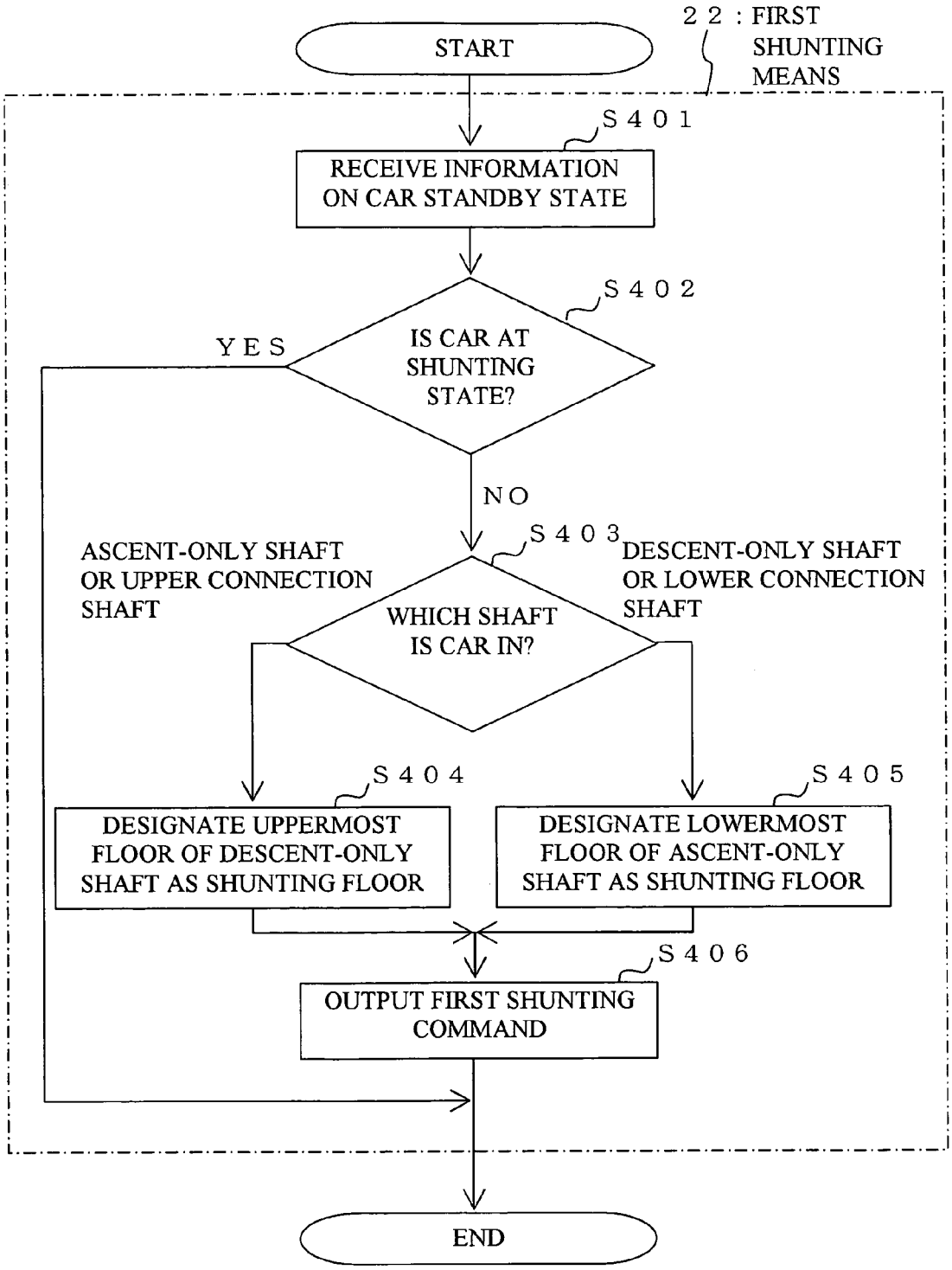
FIG. 4 is a flowchart illustrating how a blocked state is avoided by a first shunting means in the first embodiment of the present invention.

Control methods for avoiding these blocked states will now be described. FIG. 4 is a flowchart illustrating procedures for avoiding a blocked state by the first shunting means 22 of the first embodiment of the present invention. The first shunting means 22 serves to avoid a blocked state as shown in FIG. 3A. The flowchart of FIG. 4 will be sequentially explained based on the car position shown in FIG. 3A.

After the passengers have got on/off the car 31 at a midway floor of the ascent shaft 1, the door of the car is closed, and the car is brought into the standby state. Information on the car 31 in this standby state and information on the current position of the car 31 are transmitted to the first shunting means 22 through the communication means 21 from the individual car control device 11 for the car 31 (see FIG. 1). When it receives the information on the standby state of the car 31 (S401), the first shunting means 22 makes a judgment, from the information on the current position of the car 31, as to whether the car 31 is at a pre-designated, predetermined shunting floor (S402).

When it is determined that the car 31 is already at the predetermined shunting floor, the first shunting means 22 completes its operation, without performing any further procedures. When it is determined that the car 31 is not at the predetermined shunting floor, the first shunting means 22 makes a judgment as to in which shaft the car 31 is at rest on the basis of the information on the current position of the car 31 (S403).

When it is determined that the car 31 is at rest in the ascent shaft 1 or the upper connection shaft 4, the first shunting means 22 designates the uppermost floor of the descent shaft 2 as the predetermined shunting floor (S404). By designating the uppermost floor of the descent shaft 2 as the predetermined shunting floor, movement of the succeeding car 32 in the ascent shaft 1 is not hindered. Further, the car 31 is kept on standby at the uppermost floor of the descent shaft 2, whereby a downward call request from a passenger can be efficiently responded to.

On the other hand, when it is determined that the car 31 is at rest in the descent shaft 2 or the lower connection shaft 3, the first shunting means 22 designates the lowermost floor of the ascent shaft 1 as the predetermined shunting floor (S405). By designating the lowermost floor of the ascent shaft 1 as the predetermined shunting floor, movement of the succeeding car 32 in the descent shaft 2 is not hindered. Further, the car 31 is kept on standby at the lowermost floor of the ascent shaft 1, of which frequent get-on request is to be expected, whereby a call request for ascent from a passenger can be efficiently responded to.

Then, the first shunting means 22 outputs a first shunting command to move the car 31 to the shunting floor designated by the above processing (S406), and completes its operation. The first shunting command thus output is sent to the collective operation control means 25, and collective control is performed.

It is possible to avoid the blocked state as shown in FIG. 3A by the above procedures. In the blocked states as shown in FIGS. 3B and 3C, however, the preceding car 31 is already on standby at the predetermined shunting floor in the ascent shaft 1. Thus, in these states, no new shunting command for the preceding car 31 is generated by the procedures of the flowchart of FIG. 4, which means, as it is, it is impossible to avoid such blocked states.

Figure 5:
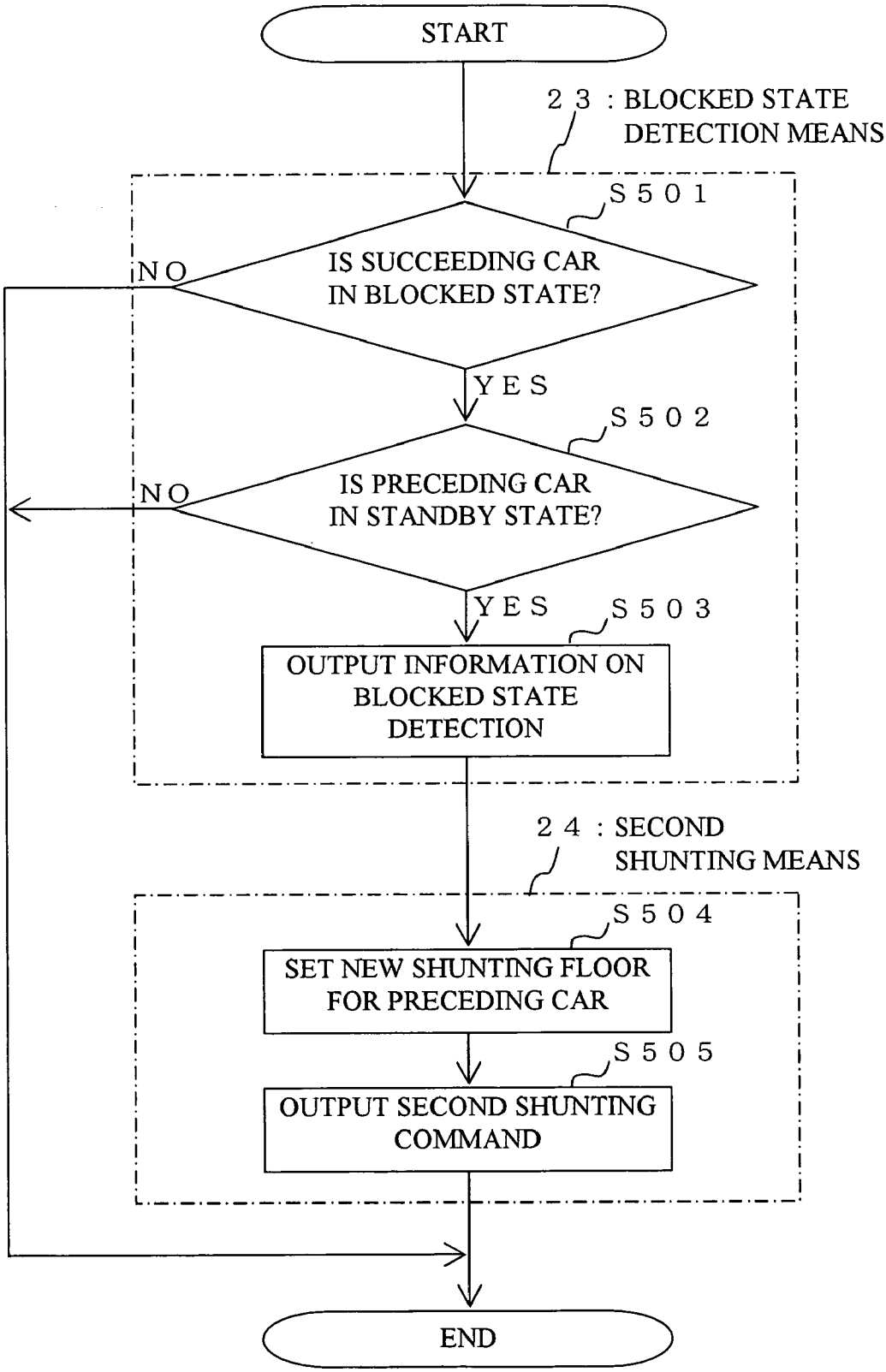
FIG. 5 is a flowchart illustrating how a blocked state is avoided by a blocked state detection means and a second shunting means in the first embodiment of the present invention.

In this regard, new control procedures for avoiding the blocked states as shown in FIGS. 3B and 3C will be described. FIG. 5 is a flowchart illustrating the procedures for avoiding blocked states by the blocked state detection means 23 and the second shunting means 24 of the first embodiment of the present invention.

The blocked state detection means 23 makes a judgment, from positional information on each car, as to whether a blocked state has been generated in which a succeeding car cannot run due to a preceding car (S501). When it is determined that no blocked state has been generated, the blocked state detection means 23 completes its processing without performing any further operations. When it is determined that a blocked state has been generated, the blocked state detection means 23 makes a judgment as to whether a preceding car causing the blocked state is on standby at a predetermined shunting floor (S502).

When it is determined that the preceding car is not on standby at the predetermined shunting floor, the blocked state detection means 23 completes its operation without performing any further processing. In such a blocked state, the procedures of FIG. 4 are followed with the result that the succeeding car moves after the preceding car is moved by the first shunting means 22. When it is determined that the preceding car is on standby at the predetermined shunting floor, the blocked state detection means 23 outputs blocked state detection information (S503).

Next, when the blocked state detection information from the blocked state detection means 23 has been read, the second shunting means 24 sets a new shunting floor for the preceding car (S504). This new shunting floor may, for example, be an intermediate floor in the ascent shaft 1 in FIG. 3B.

Then, the second shunting means 24 outputs a second shunting command in order to move the car 31 to the new shunting floor designated in the above processing (S505), and completes its processing. The second shunting command thus output is sent to the collective operation control means 25, where collective control is conducted.

In the elevator control device of the first embodiment, it is possible to previously move a car that has responded to a call request to a predetermined shunting floor and keep it on standby. Further, also when a blocked state is generated in a case in which the preceding car is already on standby at the predetermined floor, it is possible to move the preceding car to a new shunting floor. As a result, it is possible to realize an elevator control device which does not hinder the running of a succeeding car and which can efficiently respond to a request call from the passenger.

Second Embodiment

Next, other procedures for avoiding the blocked states as shown in FIGS. 3B and 3C will be described. In the procedures of the first embodiment shown in FIG. 5, when the blocked state as shown in FIG. 3B is generated, a second shunting command is immediately generated for the preceding car 31. However, the succeeding car 32, which is at rest in the lower connection shaft 3, normally contains no passengers. Thus, even if such a blocked state is not got rid of at once, there is at least no fear of passengers being shut up in the car 32.

Further, if, although a floor of which a large number of passengers and high getting-on frequency are to be expected is set as the predetermined shunting floor and the preceding car 31 is kept on standby there, movement to a new shunting floor is effected, with no passengers in the preceding car 31, that may lead to a deterioration in transportation efficiency.

Thus, to avoid a blocked state while preventing a deterioration in transportation efficiency, it will be expedient to loosen the judgment condition for the blocked state in step S501 of FIG. 5. That is, it will be expedient to define the judgment condition for the blocked state as follows: "There are N (N is a positive number not less than 1) consecutive succeeding cars in a blocked state in which they are incapable of running due to a preceding car", thus introducing the parameter N.

Here, N is a parameter that can be appropriately set according to the number of cars to be run, the length of the connection shafts, the operation pattern, etc. In the first embodiment, a second shunting command is output upon generation of a blocked state even if there is only one succeeding car, which means the first embodiment corresponds to the case in which N=1.

Assuming that N is 2 or more, the state of FIG. 3B is not judged to be a blocked state, and no second shunting command is output for the car 31. Thus, the car 31 remains on standby at the current shunting floor until a call request from a landing hall is assigned thereto. Further, assuming N=4, the state of FIG. 3C is temporarily generated. Thereafter, this state is judged to be a blocked state, and a second shunting command for the car 31 is output, whereby the car 31 moves to a new shunting floor, and then the succeeding cars 32 through 35 move successively.

In accordance with the second embodiment of the present invention, an appropriate value is selected for the parameter N for detecting a blocked state according to the number of cars to be run, the length of the connection shafts, the operation pattern, etc., whereby it is possible to realize an elevator control device which can avoid a blocked state and which helps to achieve an improvement in transportation efficiency.

While in the above-described first and second embodiments the first shunting means 22 and the second shunting means 24 are provided as the shunting means, this should not be construed restrictively. It is also possible to provide solely the second shunting means 24. The operation in the case in which only the second shunting means is adopted corresponds to the operation in the case in which the predetermined shunting floor to be set by the first shunting means 22 remains the current floor at which a car that has responded to a call request is at rest.

Further, while in the first and second embodiments described above, there are two predetermined shunting floors, i.e., the uppermost floor of the descent shaft and the lowermost floor of the ascent shaft, this should not be construed restrictively. It is possible to appropriately set the number and positions of floors set as predetermined shunting floors according to the number of cars to be run, the length of the connection shafts, the operation pattern, etc., thereby making it possible to avoid a blocked state and, at the same time, achieve an improvement in transportation efficiency.

Further, regarding the new shunting floor also, it can be appropriately set as in the case of the predetermined shunting floor. Further, it is also possible to set still another new shunting floor for a case in which a blocked state is generated at the new shunting floor.

Further, there is no need for the parameter N in the second embodiment to be fixed to a single value for the elevator control device as a whole; it is possible to set an optimum value according to the position of a predetermined shunting floor. For example, it is possible for the parameter N to be 2 at the lowermost floor of the ascent floor, thus giving priority to the standby state at the lowermost floor, and it is possible for the parameter N to be 1 at the uppermost floor of the descent shaft, thus giving priority to avoidance of a blocked state. This makes it possible to increase the probability of a car being on standby at the lowermost floor, of which high frequency of use is to be expected, with respect to a call request for ascent. Further, with respect to a call request for descent, it is possible for a car to be kept on standby not only at the uppermost floor but also at any other floor, thereby optimizing the efficiency of the system as a whole.

What is claimed is:

1. An elevator control device comprising:

a plurality of cars running in a circulating running shaft including an ascent shaft and a descent shaft interconnected at upper and lower terminal portions thereof;

a plurality of individual car control devices for independently controlling the plurality of cars; and a group supervisory control device for collective control of the plurality of individual car control devices, and including communication means for transmission of information to and reception of information from the plurality of individual car control devices;

first shunting means for outputting a first shunting command for moving a car which has responded to a call request to a predetermined shunting floor, based on information concerning each car received from the plurality of individual car control devices;

blocked state detection means for detecting, based on the information concerning each car received from the plurality of individual car control devices through the communication means, a blocked state in which a succeeding car is being blocked by a preceding car that is in a standby state at the predetermined shunting floor; and second shunting means for outputting a second shunting command for moving the preceding car, which is in the standby state at the predetermined shunting floor, to a new shunting floor when the blocked state detection means detects that the succeeding car is in the blocked state.

2. An elevator control method for controlling a plurality of cars running in a circulating running shaft including an ascent shaft and descent shaft interconnected at upper and lower terminal portions thereof, the method comprising:

moving a car which has responded to a call request to a predetermined shunting floor based on positional information for each of the plurality of cars;

detecting, based on the positional information for each of the plurality of cars, a blocked state in which a succeeding car is being blocked by a preceding car that is in a standby state at the predetermined shunting floor; and moving the preceding car, which is in the standby state at the predetermined shunting floor, to a new shunting floor when the blocked state of the succeeding car is detected.

* * * * *